US010718536B2

(12) United States Patent
Hancock

(10) Patent No.: US 10,718,536 B2
(45) Date of Patent: Jul. 21, 2020

(54) BLOWER HOUSING WITH TWO POSITION CUTOFF

(71) Applicant: Trane International Inc., Davidson, NC (US)

(72) Inventor: Stephen Stewart Hancock, Flint, TX (US)

(73) Assignee: Trane International Inc., Davidson, NC (US)

( * ) Notice: Subject to any disclaimer, the term of this patent is extended or adjusted under 35 U.S.C. 154(b) by 376 days.

(21) Appl. No.: 15/594,028

(22) Filed: May 12, 2017

(65) Prior Publication Data

US 2018/0328369 A1 Nov. 15, 2018

(51) Int. Cl.

| | |
|---|---|
| ***F24F 7/06*** | (2006.01) |
| ***F04D 29/42*** | (2006.01) |
| ***F04D 29/62*** | (2006.01) |
| ***F24F 13/20*** | (2006.01) |

(52) U.S. Cl.

CPC ..... *F24F 7/065* (2013.01); *F04D 29/422* (2013.01); *F04D 29/622* (2013.01); *F04D 29/626* (2013.01); *F24F 2013/205* (2013.01)

(58) Field of Classification Search

CPC ... F24F 7/065; F24F 2013/205; F04D 29/626; F04D 29/622; F04D 29/422; F04D 29/462

See application file for complete search history.

(56) References Cited

U.S. PATENT DOCUMENTS

| | | | | |
|---|---|---|---|---|
| 1,056,813 | A * | 3/1913 | McLean | F03D 7/02 415/46 |
| 3,306,528 | A | 2/1967 | Eck | |
| 5,551,838 | A | 9/1996 | Hugbart | |
| 5,570,996 | A | 11/1996 | Smiley, III | |
| 6,450,765 | B1 | 9/2002 | Carroll et al. | |
| 6,591,516 | B2 | 7/2003 | Kamada et al. | |
| 6,755,615 | B2 | 6/2004 | Chapman | |
| 7,014,422 | B2 | 3/2006 | Hancock | |
| 7,108,478 | B2 | 9/2006 | Hancock | |
| 7,144,219 | B2 | 12/2006 | Hancock | |
| D537,517 | S | 2/2007 | Hancock | |

(Continued)

OTHER PUBLICATIONS customairproducts.com/what-is-an-air-handling-unit-ahu/ (Year: 2013).*

(Continued)

*Primary Examiner* — Patrick Hamo
*Assistant Examiner* — David N Brandt
(74) *Attorney, Agent, or Firm* — Conley Rose, P.C.; J. Robert Brown, Jr.; James A. Hooper

(57) ABSTRACT

A heating, ventilation, and/or air conditioning (HVAC) system includes a blower assembly having a blower housing configured to operate with various sized impellers. The blower housing includes a cutoff that is selectively radially adjustable to locate a leading edge of the cutoff in a position relative to one of the various sized impellers to maintain a proper clearance between the leading edge of the cutoff and one of the various sized impellers in order to efficiently separate blower discharge airflow from incoming airflow collected in the blower housing and prevent recirculation of the blower discharge airflow through the blower housing.

18 Claims, 6 Drawing Sheets

(56) References Cited

U.S. PATENT DOCUMENTS

| | | | | |
|---|---|---|---|---|
| 7,591,633 | B2 * | 9/2009 | Hancock | F04D 29/4226 415/206 |
| 7,748,954 | B2 | 7/2010 | Hancock | |
| 8,602,723 | B2 * | 12/2013 | Chou | F04D 29/422 415/126 |
| 9,039,363 | B2 | 5/2015 | Hancock | |
| 9,188,137 | B2 | 11/2015 | Hancock | |
| 9,279,429 | B2 | 3/2016 | Hancock | |
| 2005/0163614 | A1 | 7/2005 | Chapman | |
| 2007/0059167 | A1 | 3/2007 | Hancock | |
| 2008/0095629 | A1 | 4/2008 | Eguchi et al. | |
| 2013/0209245 | A1 | 8/2013 | Iyer et al. | |
| 2015/0330394 | A1 | 11/2015 | Cocks et al. | |
| 2016/0177810 | A1 | 6/2016 | Gullberg et al. | |
| 2017/0051749 | A1 | 2/2017 | Cho et al. | |

OTHER PUBLICATIONS

Office Action dated Mar. 7, 2019; U.S. Appl. No. 15/368,003, filed Dec. 2, 2016; 21 pages.

Office Action dated Jan. 14, 2019; U.S. Appl. No. 15/609,923, filed May 31, 2017; 15 pages.

Hancock, Stephen Stewart; U.S. Appl. No. 15/368,003, filed Dec. 2, 2016; Title: Blower Housing Labyrinth Seal; 35 pages.

Hancock, Stephen Stewart; U.S. Appl. No. 15/609,923, filed May 31, 2017; Title: Momentum Based Blower Interstitial Seal; 37 pages.

Final Office Action dated Jul. 11, 2019; U.S. Appl. No. 15/609,923, filed May 31, 2017; 16 pages.

Final Office Action dated Sep. 6, 2019; U.S. Appl. No. 15/368,003, filed Dec. 2, 2016; 17 pages.

Notice of Allowance dated Jan. 23, 2020; U.S. Appl. No. 15/368,003, filed Dec. 2, 2016; 9 pages.

* cited by examiner

BLOWER HOUSING WITH TWO POSITION CUTOFF

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generally be used in residential and/or commercial structures to provide heating and/or cooling in order to create comfortable conditions inside climate conditioned areas associated with such structures. To provide an airflow of conditioned air into such conditioned areas, most HVAC systems employ a fan to move the conditioned air through the HVAC system and into the climate conditioned areas. Further, to maximize performance of the HVAC system, it is crucial to maximize the performance and/or efficiency of the fan.

SUMMARY OF THE DISCLOSURE

In some embodiments, a blower assembly is disclosed as comprising: a blower housing comprising an adjustable cutoff; wherein the adjustable cutoff is selectively adjustable to maintain a clearance between a leading edge of the cutoff and a plurality of various sized impellers in the blower housing.

In other embodiments, a heating, ventilation, and/or air conditioning (HVAC) system is disclosed as comprising: a component; and a blower assembly configured to generate an airflow through the component, the blower assembly comprising: a blower housing comprising an adjustable cutoff; wherein the adjustable cutoff is selectively adjustable to maintain a clearance between a leading edge of the cutoff and a plurality of various sized impellers in the blower housing.

In yet other embodiments of the disclosure, a method of assembling a blower assembly is disclosed as comprising: determining an airflow requirement of an HVAC system; selecting an impeller configured to provide an airflow in accordance with the airflow requirement; installing the selected impeller in a blower housing; selectively adjusting a position of a cutoff in accordance with the selected impeller; and securing the cutoff in the adjusted position.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

In some cases, it may be desirable to provide a heating, ventilation, and/or air conditioning (HVAC) system with a blower assembly that is configured to operate with various sized impellers. For example, various HVAC systems may often require different airflow requirements and/or capacities. Accordingly, it may be desirable to apply impellers of different diameters in the same housing to expand the range of applications for the particular blower assembly. However, if a smaller diameter impeller is installed in a blower housing that is also configured to accept larger impellers, the airflow provided by the blower assembly may suffer since the cutoff that separates the blower discharge airflow from the incoming airflow collected in the blower housing may not be positioned efficiently with respect to the impeller and/or the blower housing. Accordingly, systems and methods are disclosed herein that comprise providing a blower housing with a multi-position, adjustable cutoff that maximizes the airflow output of the blower assembly for various configurations when different sized impellers are used in the same blower housing.

Figure 1:
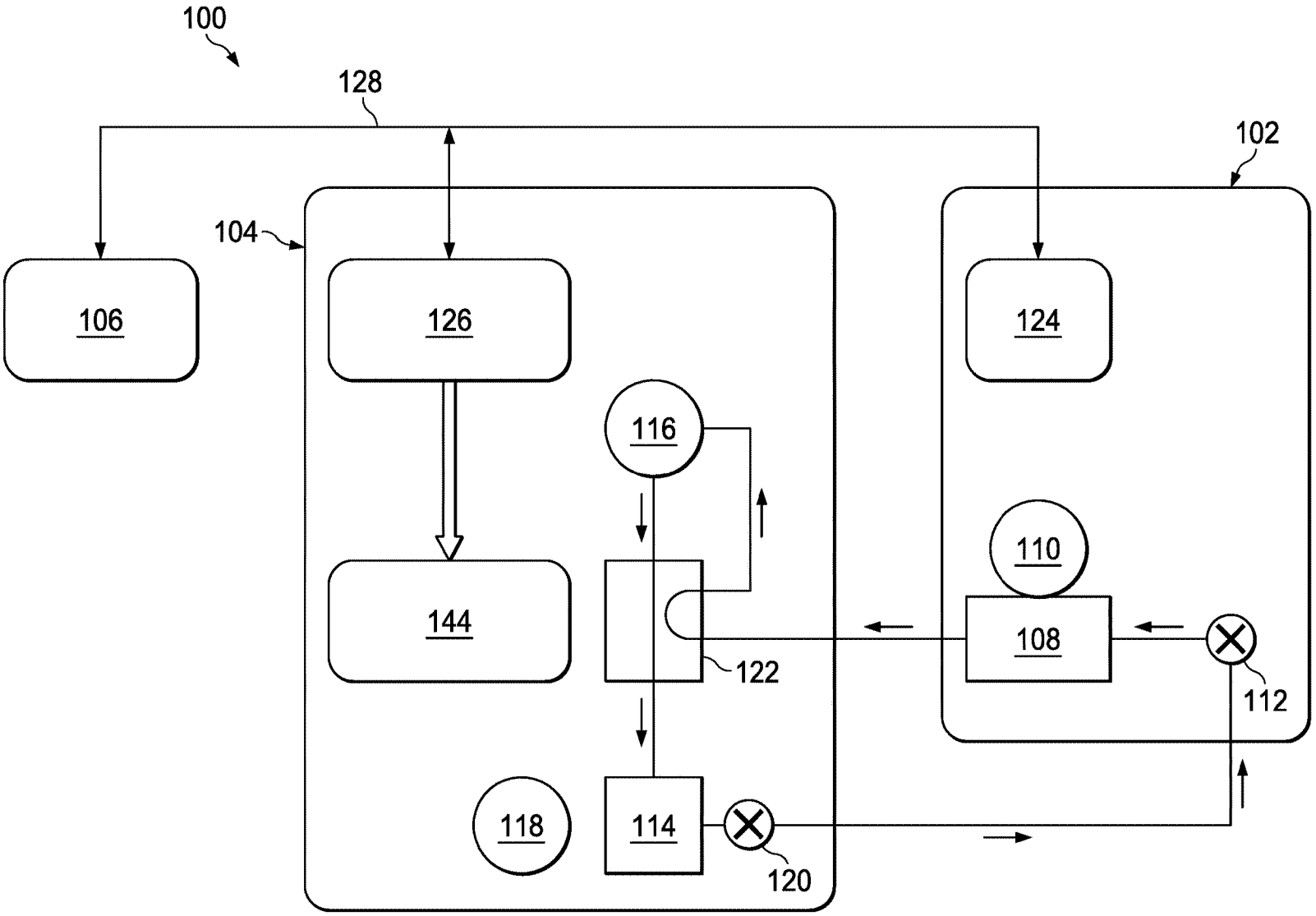
FIG. 1 is a schematic diagram of a heating, ventilation, and/or air conditioning (HVAC) system according to an embodiment of the disclosure.

Referring now to FIG. 1, a schematic diagram of a heating, ventilation, and/or air conditioning (HVAC) system 100 is shown according to an embodiment of the disclosure. Most generally, HVAC system 100 comprises a heat pump system that may be selectively operated to implement one or more substantially closed thermodynamic refrigeration cycles to provide a cooling functionality (hereinafter "cooling mode") and/or a heating functionality (hereinafter "heating mode"). The HVAC system 100, configured as a heat pump system, generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between refrigerant carried within internal tubing of the indoor heat exchanger 108 and an airflow that may contact the indoor heat exchanger 108 but that is segregated from the refrigerant. In some embodiments, the indoor heat exchanger 108 may comprise a plate-fin heat exchanger. However, in other embodiments, indoor heat exchanger 108 may comprise a microchannel heat exchanger and/or any other suitable type of heat exchanger.

The indoor fan 110 may generally comprise a variable speed blower comprising a blower housing, a blower impeller at least partially disposed within the blower housing, and a blower motor configured to selectively rotate the blower impeller. The indoor fan 110 may generally be configured to provide airflow through the indoor unit 102 and/or the indoor heat exchanger 108 to promote heat transfer between the airflow and a refrigerant flowing through the indoor heat exchanger 108. The indoor fan 110 may also be configured to deliver temperature-conditioned air from the indoor unit 102 to one or more areas and/or zones of a climate controlled structure. The indoor fan 110 may generally be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, however, the indoor fan 110 may be a single speed fan.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device. In some embodiments, while the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, a reversing valve 122, and an outdoor controller 126. In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In alternative embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump. In some embodiments, the compressor 116 may be controlled by a compressor drive controller 144, also referred to as a compressor drive and/or a compressor drive system.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or the outdoor heat exchanger 114 to promote heat transfer between the airflow and a refrigerant flowing through the outdoor heat exchanger 114. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan. Further, in other embodiments, however, the outdoor fan 118 may comprise a mixed-flow fan, a centrifugal blower, and/or any other suitable type of fan and/or blower.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flowpath of refrigerant through the reversing valve 122 and consequently the HVAC system 100. Additionally, the reversing valve 122 may also be selectively controlled by the system controller 106 and/or an outdoor controller 126.

The system controller 106 may generally be configured to selectively communicate with an indoor controller 124 of the indoor unit 102, an outdoor controller 126 of the outdoor unit 104, and/or other components of the HVAC system 100. In some embodiments, the system controller 106 may be configured to control operation of the indoor unit 102 and/or the outdoor unit 104. In some embodiments, the system controller 106 may be configured to monitor and/or communicate with a plurality of temperature sensors associated with components of the indoor unit 102, the outdoor unit 104, and/or the ambient outdoor temperature. Additionally, in some embodiments, the system controller 106 may comprise a temperature sensor and/or a humidity sensor and/or may further be configured to control heating and/or cooling of zones associated with the HVAC system 100. In other embodiments, however, the system controller 106 may be configured as a thermostat for controlling the supply of conditioned air to zones associated with the HVAC system 100.

The system controller 106 may also generally comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, however, the system controller 106 may not comprise a display and may derive all information from inputs from remote sensors and remote configuration tools.

In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128.

The indoor controller 124 may be carried by the indoor unit 102 and may generally be configured to receive information inputs, transmit information outputs, and/or otherwise communicate with the system controller 106, the outdoor controller 126, and/or any other device via the communication bus 128 and/or any other suitable medium of communication. In some embodiments, the indoor controller 124 may be configured to receive information related to a speed of the indoor fan 110, transmit a control output to an auxiliary heat source, transmit information regarding an indoor fan 110 volumetric flow-rate, communicate with and/or otherwise affect control over an air cleaner, and communicate with an indoor EEV controller. In some embodiments, the indoor controller 124 may be configured to communicate with an indoor fan 110 controller and/or otherwise affect control over operation of the indoor fan 110.

The outdoor controller 126 may be carried by the outdoor unit 104 and may be configured to receive information inputs, transmit information outputs, and/or otherwise communicate with the system controller 106, the indoor controller 124, and/or any other device via the communication bus 128 and/or any other suitable medium of communication. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the compressor 116, the outdoor fan 118, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with and/or control a compressor drive controller 144 that is configured to electrically power and/or control the compressor 116.

The HVAC system 100 is shown configured for operating in a so-called cooling mode in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant may primarily comprise liquid phase refrigerant and the refrigerant may flow from the outdoor heat exchanger 114 to the indoor metering device 112 through and/or around the outdoor metering device 120 which does not substantially impede flow of the refrigerant in the cooling mode. The indoor metering device 112 may meter passage of the refrigerant through the indoor metering device 112 so that the refrigerant downstream of the indoor metering device 112 is at a lower pressure than the refrigerant upstream of the indoor metering device 112. The pressure differential across the indoor metering device 112 allows the refrigerant downstream of the indoor metering device 112 to expand and/or at least partially convert to a two-phase (vapor and gas) mixture. The two-phase refrigerant may enter the indoor heat exchanger 108. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108, and causing evaporation of the liquid portion of the two-phase mixture. The refrigerant may thereafter re-enter the compressor 116 after passing through the reversing valve 122.

To operate the HVAC system 100 in the so-called heating mode, the reversing valve 122 may be controlled to alter the flow path of the refrigerant, the indoor metering device 112 may be disabled and/or bypassed, and the outdoor metering device 120 may be enabled. In the heating mode, refrigerant may flow from the compressor 116 to the indoor heat exchanger 108 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may re-enter the compressor 116 after passing through the reversing valve 122. Most generally, operation of the HVAC system 100 in the heating mode reverses the roles of the indoor heat exchanger 108 and the outdoor heat exchanger 114 as compared to their operation in the cooling mode.

Figure 2:
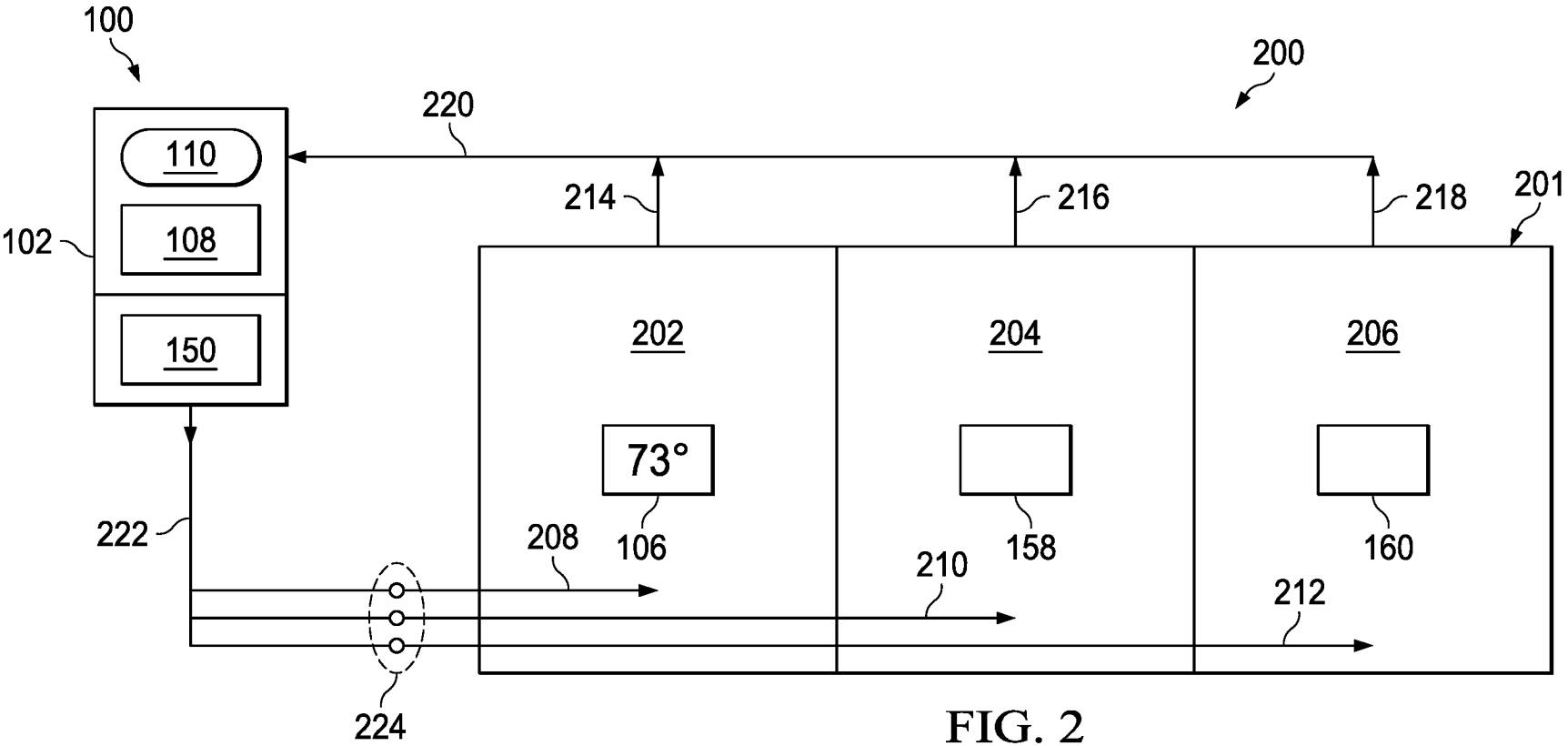
FIG. 2 is a schematic diagram of an air circulation path of the HVAC system of FIG. 1 according to an embodiment of the disclosure.

Referring now to FIG. 2, a schematic diagram of an air circulation path 200 of the HVAC system 100 of FIG. 1 is shown according to an embodiment of the disclosure. The HVAC system 100 of FIG. 1 may generally comprise an indoor fan 110 configured to circulate and/or condition air through a plurality of zones 202, 204, 206 of a structure 201. It will be appreciated that while three zones 202, 204, 206 are shown, any number of zones may be present in the structure 201. The air circulation path 200 of the HVAC system 100 may generally comprise a first zone supply duct 208, a second zone supply duct 210, a third zone supply duct 212, a first zone return duct 214, a second zone return duct 216, a third zone return duct 218, a main return duct 220, a main supply duct 222, a plurality of zone dampers 224, and an indoor unit 102 comprising an indoor heat exchanger 108, and an indoor fan 110. In some embodiments, the HVAC system 100 may also comprise a heat source 150. In some embodiments, the heat source 150 may comprise electrical resistance heating elements installed in the indoor unit 102. However, in other embodiments, the heat source 150 may comprise a furnace configured to burn fuel such as, but not limited to, natural gas, heating oil, propane, and/or any other suitable fuel, to generate heat. Further, in embodiments where the heat source 150 comprises a furnace, it will be appreciated that the furnace may also comprise an inducer blower substantially similar to the indoor fan 110 that may be configured to circulate an air-fuel mixture through the furnace.

Additionally, the HVAC system 100 may further comprise a zone thermostat 158 and a zone sensor 160. In some embodiments, a zone thermostat 158 may communicate with the system controller 106 and may allow a user to control a temperature setting, a humidity setting, and/or other environmental setting for the zone 202, 204, 206 in which the zone thermostat 158 is located. Further, the zone thermostat 158 may communicate with the system controller 106 to provide temperature, humidity, and/or other environmental feedback regarding the zone 202, 204, 206 in which the zone thermostat 158 is located. In some embodiments, a zone sensor 160 may also communicate with the system controller 106 to provide temperature, humidity, and/or other environmental feedback regarding the zone 202, 204, 206 in which the zone sensor 160 is located. Further, although only one zone thermostat 158 and one zone sensor 160 are shown, each of the zones 202, 204, 206 may comprise a zone thermostat 158 and/or a zone sensor 160.

The system controller 106 may be configured for bidirectional communication with any zone thermostat 158 and/or zone sensor 160 so that a user may, using the system controller 106, monitor and/or control any of the HVAC system 100 components regardless of which zones 202, 204, 206 the zone thermostat 158 and/or zone sensor 160 may be associated. Further, each system controller 106, each zone thermostat 158, and each zone sensor 160 may comprise a temperature sensor and/or a humidity sensor. As such, it will be appreciated that structure 201 is equipped with a plurality of temperature sensors and/or humidity sensors in the plurality of different zones 202, 204, 206. In some embodiments, a user may effectively select which of the plurality of temperature sensors and/or humidity sensors is used to control operation of the HVAC system 100. Thus, when at least one of the system controller 106, the zone thermostat 158, and the zone sensor 160 determines that a temperature and/or humidity of an associated zone has fallen outside either the temperature setting or the humidity setting, respectively, the system controller 106 may operate the HVAC system 100 in either the cooling mode or the heating mode to provide temperature conditioned air to at least one of the zones 202, 204, 206. Additionally the system controller 106 may also activate and/or operate the heat source 150 to provide heat and/or dehumidification while operating in the heating mode.

In operation, the indoor fan 110 may be configured to generate an airflow through the indoor unit 102 and/or the heat source 150 to deliver conditioned air from an air supply opening in the indoor unit 102, through the main supply duct 222, and to each of the plurality of zones 202, 204, 206 through each of the first zone supply duct 208, the second zone supply duct 210, and the third zone supply duct 212, respectively. Additionally, each of the first zone supply duct 208, the second zone supply duct 210, and the third zone supply duct 212 may comprise a zone damper 224 that regulates the airflow to each of the zones 202, 204, 206. In some embodiments, the zone dampers 224 may regulate the flow to each zone 202, 204, 206 in response to a temperature or humidity sensed by at least one temperature sensor and/or humidity sensor carried by at least one of the system controller 106, the zone thermostat 158, and the zone sensor 160.

Air from each zone 202, 204, 206 may return to the main return duct 220 through each of the first zone return duct 214, the second zone return duct 216, and the third zone return duct 218. From the main return duct 220, air may return to the indoor unit 102 through an air return opening in the indoor unit 102. Air entering the indoor unit 102 through the air return opening may then be conditioned for delivery to each of the plurality of zones 202, 204, 206 as described above. Circulation of the air in this manner may continue repetitively until the temperature and/or humidity of the air within the zones 202, 204, 206 conforms to a target temperature and/or a target humidity as required by at least one of the system controller 106, the zone thermostat 158, and/or the zone sensor 160.

Figure 3:
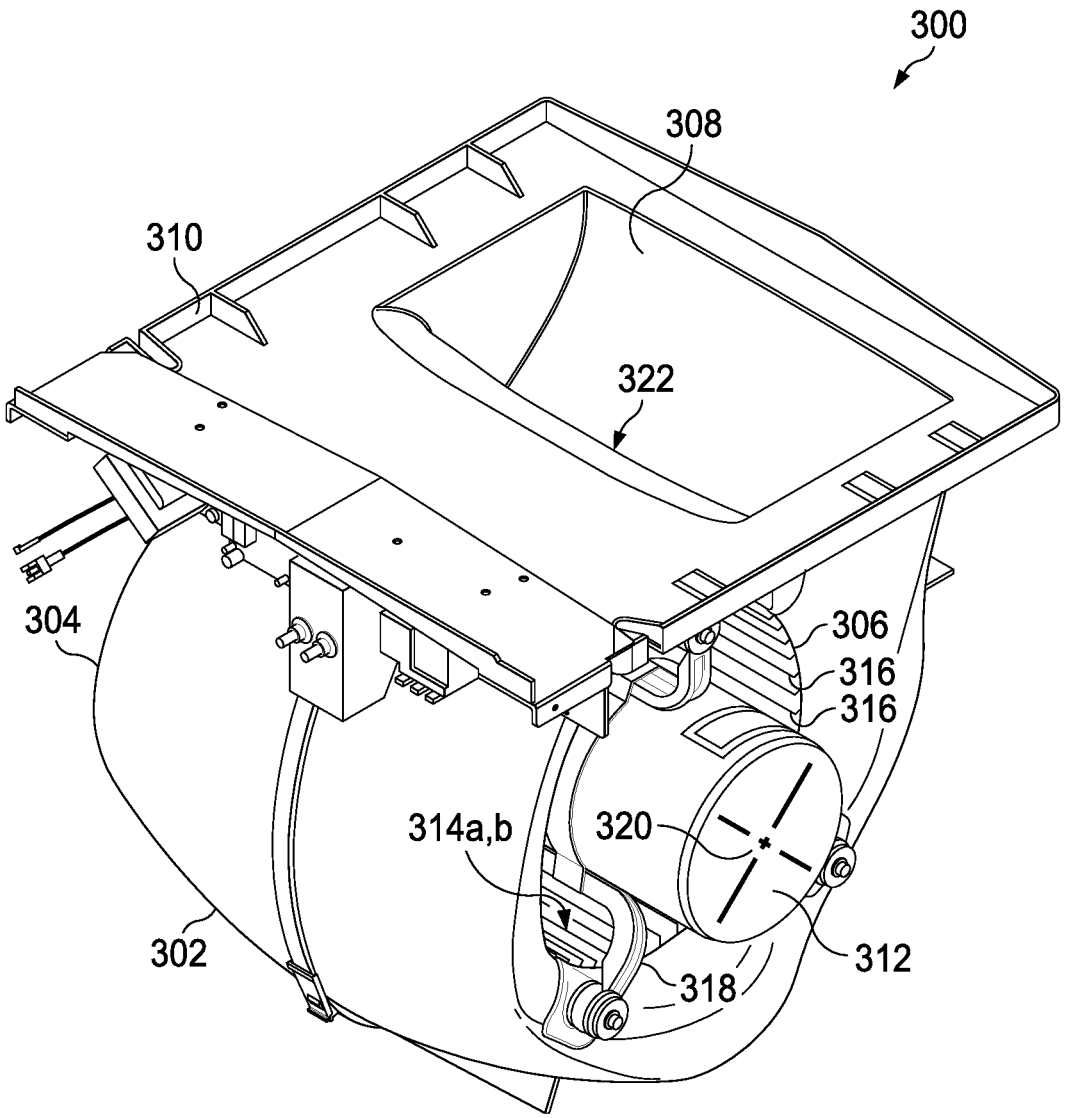
FIG. 3 is an oblique view of a blower assembly according to an embodiment of the disclosure.

Referring now to FIG. 3, an oblique view of a blower assembly 300 is shown according to an embodiment of the disclosure. Blower assembly 300 may generally be substantially similar to the indoor fan 110 of FIGS. 1 and 2 and be installed in an HVAC system 100 in a substantially similar manner to that of indoor fan 110 of FIGS. 1 and 2. Blower assembly 300 generally comprises a blower housing 302 comprising a left inlet 304, a right inlet 306, and an outlet 308 disposed through a blower deck 310. Blower assembly 300 also comprises a motor 312 comprising a shaft upon which an impeller 314 comprising a plurality of fan blades 316 disposed about the impeller 314 is mounted. Additionally, the motor 312 may be secured to the blower housing 302 via a plurality of mounts 318. A primary function of the blower housing 302 is to receive at least a portion of each of the motor 312 and the impeller 314 while also defining an airflow path between each of the opposing left inlet 304 and right inlet 306 of the blower housing 302 and the outlet 308 of the blower housing 302. Further, it will be appreciated that in some embodiments, the blower deck 310 of the blower housing 302 may be used to mount the blower assembly 300. Still further, as will be discussed further herein, it will be appreciated that the blower housing 302 may be configured to receive and operate with various sized impellers 314*a*, 314*b*. Blower housing 302 may also comprise an adjustable cutoff 322 that may be selectively adjustable based on which of the impellers 314*a*, 314*b* is installed and used in the blower housing 302.

In operation, the motor 312 may be operated to selectively rotate the impeller 314 about an axis of rotation 320 of the shaft of the motor 312. The selective rotation of the impeller 314 and the configuration of the blades 316 of the impeller 314 may generally draw an intake of air into the blower housing 302 through the left inlet 304 and/or the right inlet 306 and create a static pressure within the blower housing 302. The buildup of static pressure within the blower housing 302 may generate an airflow through the blower housing 302 by forcing the air received via the left inlet 304 and/or the right inlet 306 through the blower housing 302 along an internal flow path of the blower housing 302, whereby the airflow may exit the blower housing 302 through the outlet 308 of the blower housing 302. After leaving the outlet 308 of the blower housing 302, the airflow may selectively be passed through components of the HVAC system 100 of FIGS. 1 and 2.

Figure 4:
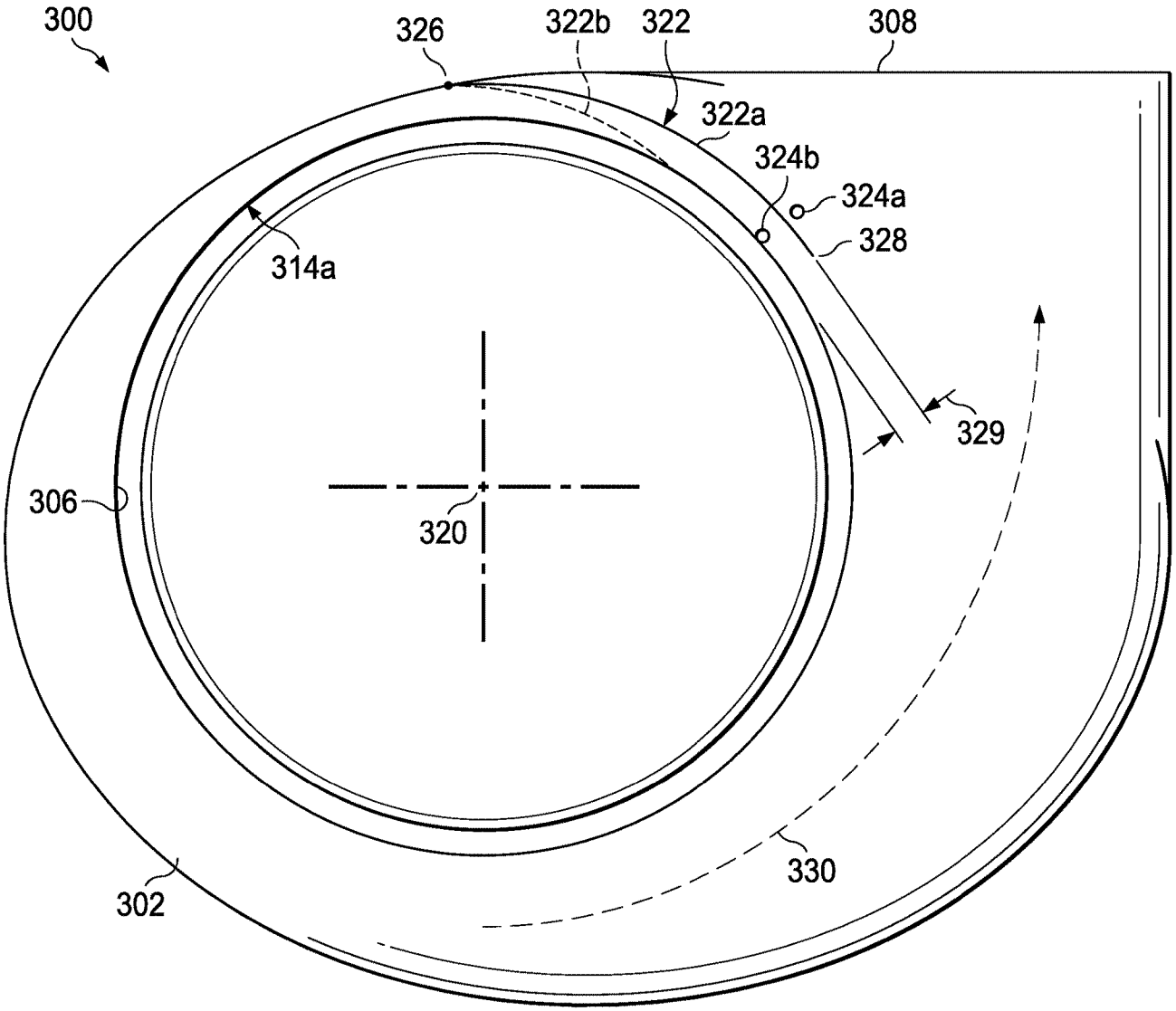
FIG. 4 is a schematic right side view of the blower assembly of FIG. 3 configured to operate with a first impeller according to an embodiment of the disclosure.

Referring now to FIG. 4, a schematic right side view of the blower assembly 300 of FIG. 3 configured to operate with a first impeller 314*a* is shown according to an embodiment of the disclosure. In this embodiment, the first impeller 314*a* may generally represent a conventional sized impeller designed for proper fitment and use in the blower housing 302. Thus, when the blower housing 302 is configured to operate with the first impeller 314*a*, the cutoff 322 may be adjusted to a first cutoff position 322*a*. The cutoff 322 may generally be adjusted by selectively moving the cutoff 322 radially inward towards the first impeller 314*a* and/or radially outward away from the first impeller 314*a*. Accordingly, a leading edge 328 of the cutoff 322 may be selectively adjusted radially inward towards the first impeller 314*a* and/or radially outward away from the first impeller 314*a*, while a pivot point 326 of the cutoff 322 remains stationary. In some embodiments, pivot point 326 may represent an interface between a stationary portion of the blower housing 302 and a beginning of the adjustable cutoff 322. Thus, in some embodiments, the cutoff 322 may be an extension of the blower housing 302. However, in other embodiments, the cutoff 322 may be a separate component affixed to the blower housing 302.

The cutoff 322 may generally be configured to separate blower discharge airflow 330 from the incoming airflow collected in the blower housing 302, so that an airflow that enters the blower housing 302 through the inlets 304, 306 and travels through the blower housing 302 is not continuously circulated through the blower housing 302. Instead, the cutoff 322 strategically separates the blower discharge airflow 330 to reduce leakage between collection and discharge portions of the blower housing 302, thereby maximizing blower discharge airflow 330 output through the outlet 308 of the blower housing 302 and improving performance stability. Additionally, when the cutoff 322 is adjusted to the first cutoff position 322*a* for use with the first impeller 314*a*, the cutoff 322 may be secured to the blower housing 302 through the use of fasteners (e.g. screws, pins, snaps, etc.) inserted into the first mounting holes 324*a* disposed on each of a left side and a right side of the blower housing 302. In some embodiments, tension in the cutoff 322 created by rotating the cutoff radially inward towards the first impeller 314*a* may force the cutoff 322 against the fasteners inserted through the first mounting holes 324*a* to hold the cutoff 322 stationary. However, in other embodiments, the cutoff 322 may comprise and inner flange and/or other feature that receives at least a portion of the fasteners inserted through the first mounting holes 324*a* to hold the cutoff 322 stationary.

Figure 5:
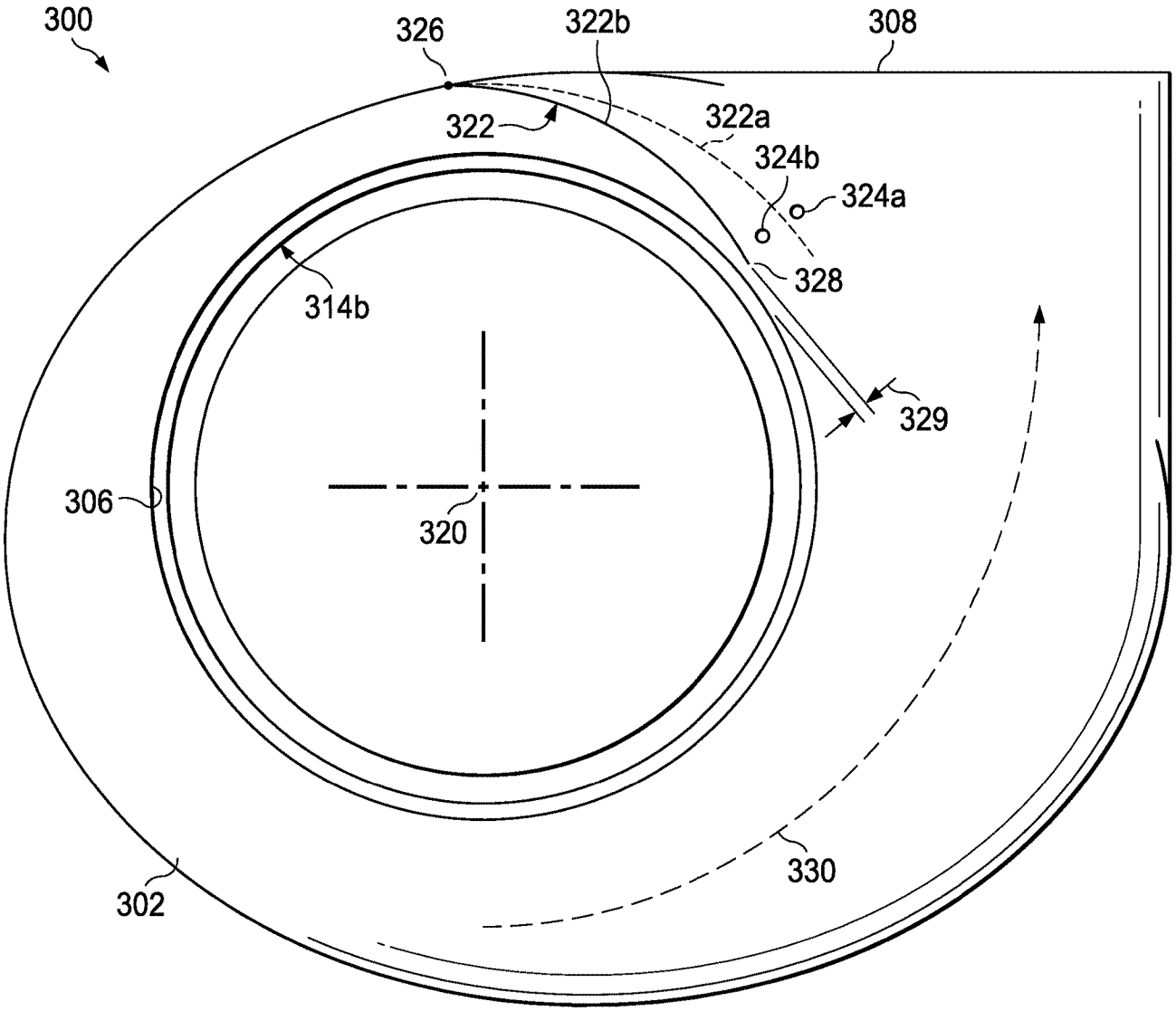
FIG. 5 is a schematic right side view of the blower assembly of FIG. 3 configured to operate with a second impeller according to an embodiment of the disclosure.

Referring now to FIG. 5, a schematic right side view of the blower assembly 300 of FIG. 3 configured to operate with a second impeller 314*b* is shown according to an embodiment of the disclosure. In this embodiment, the second impeller 314*b* comprises an overall smaller diameter than the first impeller 314*a*. In some embodiments, the second impeller 314*b* may extend at least partially radially into the inlets 304, 306 of the blower housing 302. Further, it will be appreciated that in some embodiments, the second impeller 314*b* may be configured to provide a reduced blower discharge airflow 330 as compared to the first impeller 314*a* for use in less demanding applications and/or where a high flow rate is not necessarily required by the application. Additionally, it will be appreciated that the second impeller 314*b* also comprises a substantially similar axis of rotation 320 as the first impeller 314*a*. Thus, a center of the second impeller 314*b* is not offset from a center of the first impeller 314*a* for the blower housing 302 to accommodate both impellers 314*a*, 314*b*.

When the blower housing 302 is configured to operate with the second impeller 314*b*, the cutoff 322 may be adjusted to a second cutoff position 322*a*. The cutoff 322 may generally be adjusted by selectively moving the cutoff 322 radially inward towards the second impeller 314*b* from the first cutoff position 322*a* to the second cutoff position 322*b*. Accordingly, a leading edge 328 of the cutoff 322 may be selectively adjusted radially inward towards the second impeller 314*b*, while a pivot point 326 of the cutoff 322 remains stationary. Additionally, when the cutoff 322 is adjusted to the second cutoff position 322*b* for use with the second impeller 314*b*, the cutoff 322 may be secured to the blower housing 302 through the use of fasteners (e.g. screws, pins, snaps, etc.) inserted into the second mounting holes 324*b* disposed on each of a left side and a right side of the blower housing 302 in a substantially similar manner to how the cutoff 322 is secured in the first cutoff position 322*a*.

When the second impeller 314*b* is installed in the blower housing 302 without adjusting the first cutoff position 322*a*, performance of the blower assembly 300 may be compromised since a larger gap results between the second impeller 314*b* and the cutoff 322 in the first cutoff position 322*a* that allows a portion of the blower discharge airflow 330 to be recirculated through the blower housing 302 due to an improper clearance 329 between the second impeller 314*b* and the cutoff 322 in the first cutoff position 322*a*. Accordingly, the cutoff 322 may be selectively adjusted to the second cutoff position 322*b* when the second impeller 314*b* is installed in the blower housing 302. By selectively adjusting the cutoff 322 to the second cutoff position 322*b*, the leading edge 328 of the cutoff 322 is adjusted radially inward towards the second impeller 314*b*. Thus, a proper clearance 329 between the leading edge 328 of the cutoff 322 is maintained when the second impeller 314*b* is installed. Accordingly, the blower assembly 300 may retain its performance advantages, efficiency, and/or other blower discharge airflow 330 characteristics with the second impeller 314*b* that the blower assembly 300 with the first impeller 314*a* provides.

In some embodiments, the clearance 329 between the second impeller 314*b* and the leading edge 328 of the cutoff 322 when the cutoff 322 is in the second cutoff position 322*b* may be substantially similar to the clearance 329 between the first impeller 314*a* and the leading edge 328 of the cutoff 322 when the cutoff 322 is in the first cutoff position 322*a*. Therefore, adjusting the position of the cutoff 322 from the first cutoff position 322*a* to the second cutoff position 322*b* when the second impeller 314*b* is installed in the blower housing 302 may substantially maintain a proper clearance 329 between the leading edge 328 of the cutoff 322 and the second impeller 314*b*. In some embodiments, the clearance 329 between the leading edge 328 of the cutoff 322 and each of the impellers 314*a*, 314*b* may be about 5% of the diameter of each of the impellers 314*a*, 314*b* in the first cutoff position 322*a* and second cutoff position 322*b*, respectively. However, in some embodiments, the clearance 329 in each of the positions 322*a*, 322*b* may be about 10% of the diameter of each of the impellers 314*a*, 314*b*, respectively. In yet other embodiments, the clearance 329 may be between about 5% and about 10% of the diameter of each of the impellers 314*a*, 314*b* in the first cutoff position 322*a* and second cutoff position 322*b*, respectively.

In some embodiments, by providing a blower housing 302 of a blower assembly 300 that can operate using various sized impellers 314*a*, 314*b*, a single blower housing 302 may be used for various HVAC system 100 applications. This reduces manufacturing costs of having to produce a blower housing for each sized impeller 314*a*, 314*b*. Additionally, with a single blower housing 302 configured to operate and maintain its efficiency with various sized impellers 314*a*, 314*b*, an impeller 314*a*, 314*b* may be selected and installed into the blower housing 302 of the blower assembly 300 based on the requirements of a particular application. This results in efficient manufacturing, assembly, and installation of a blower assembly 300. Further, in some applications that require a smaller capacity and/or lower airflow requirements, a blower assembly 300 may be installed using the second impeller 314*b*. However, if in that application, additional area were added based on a renovation or add-on construction, the first impeller 314*a* may be installed into the blower assembly 300 without having to replace the entire blower assembly 300, the entire indoor unit 102, and/or the entire HVAC system 100 to accommodate the larger capacity. Thus, blower housing 302 configured to operate with various sized impellers 314*a*, 314*b* may provide cost-effective retrofitting for HVAC systems 100 needing additional capacity. This further reduces labor and/or installation costs and/or equipment costs to the consumer.

Furthermore, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented. Additionally, it will be appreciated that while blower assembly 300 is depicted for use with impellers 314*a* and 314*b*, blower housing 300 may further be configured for use with a plurality of other impellers, whereby the cutoff 322 may be selectively adjusted to a plurality of other cutoff positions associated with each of the other plurality of impellers. In some embodiments, blower assembly 300 may be a component of an air handling unit, such as indoor unit 102 of HVAC system 100 of FIGS. 1 and 2. However, in some embodiments, the blower assembly 300 may be a component of a gas-fired furnace, such as the heat source 150 of HVAC system 100 of FIG. 2. In yet other embodiments, the blower assembly 300 may be a component of any other component and/or system of an HVAC system 100 that requires an airflow (e.g. geothermal heat pump systems, automotive HVAC systems, and/or any other system, device, and/or component that requires a fan to generate an airflow).

Figure 6:
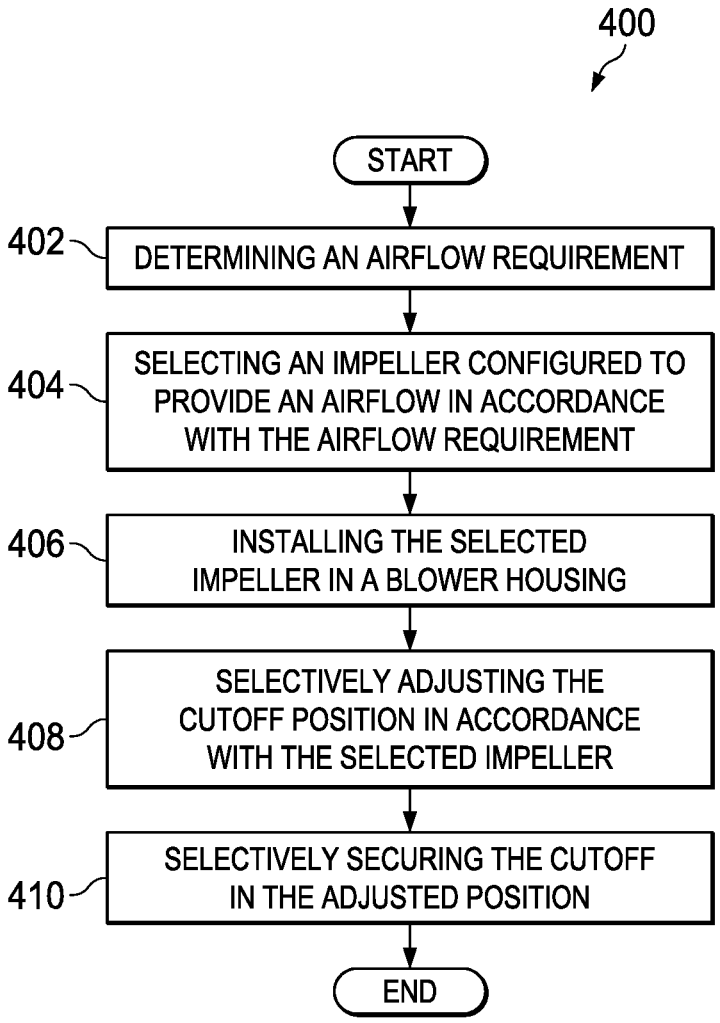
FIG. 6 is a flowchart of a method of assembling a blower assembly according to an embodiment of the disclosure.

Referring now to FIG. 6, a flowchart of a method 400 of assembling a blower assembly 300 is shown according to an embodiment of the disclosure. The method 400 may begin at block 402 by determining an airflow requirement of an HVAC system. The method 400 may continue at block 404 by selecting an impeller configured to provide an airflow in accordance with the airflow requirement. The method 400 may continue at block 406 by installing the selected impeller in a blower housing. The method may continue at block 408 by selectively adjusting the cutoff position in accordance with the selected impeller. This may be accomplished by selectively moving a cutoff 322 radially inward towards the selected impeller 314*a*, 314*b* and/or radially outward away from the selected impeller 314*a*, 314*b*. The method 400 may conclude at block 410 by securing the cutoff in the adjusted position.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value.

Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A blower assembly, comprising:

a blower housing comprising a first mounting hole, a second mounting hole spaced from the first mounting hole, a fastener, and an adjustable cutoff;

wherein the adjustable cutoff is selectively adjustable between a first position and a second position to maintain a clearance between a leading edge of the cutoff and a plurality of various sized impellers in the blower housing;

wherein the fastener is selectively positionable within the first mounting hole to secure the adjustable cutoff in the first position and within the second mounting hole to secure the adjustable cutoff in the second position;

wherein the adjustable cutoff is positioned radially between an axis of rotation of the blower assembly and the second mounting hole when the adjustable cutoff is secured in the second position, and the adjustable cutoff is positioned between the first mounting hole and the second mounting hole when the cutoff is secured in the first position;

wherein tension in the adjustable cutoff biases the adjustable cutoff radially outwards against the fastener when the adjustable cutoff is secured in the first position and the fastener is position in the first mounting hole.

2. The blower assembly of claim 1, wherein:

the adjustable cutoff is selectively adjustable between the first position to accommodate a first impeller and the second position to accommodate a second impeller; and the second position of the cutoff is radially inward from the first position of the cutoff with respect to an axis of rotation of the first impeller and the second impeller.

3. The blower assembly of claim 2, wherein the first impeller and the second impeller comprise the same axis of rotation with respect to the blower housing.

4. The blower assembly of claim 2, wherein the second impeller comprises a smaller diameter than the first impeller.

5. The blower assembly of claim 1, wherein the cutoff is an extension of the blower housing.

6. The blower assembly of claim 1, wherein the cutoff comprises a separate component affixed to the blower housing.

7. The blower assembly of claim 1, wherein the adjustable cutoff is selectively adjustable to maintain the clearance that comprises between 5% and 10% of the diameter of one of the plurality of various sized impellers.

8. The blower assembly of claim 1, wherein the blower assembly is a component of at least one of an air handling unit and a furnace.

9. A heating, ventilation, and/or air conditioning (HVAC) system, comprising:

a component; and a blower assembly configured to generate an airflow through the component, the blower assembly comprising:

a blower housing comprising a first mounting hole, a second mounting hole spaced from the first mounting hole, a fastener, and an adjustable cutoff;

wherein the adjustable cutoff is selectively adjustable between a first position and a second position to maintain a clearance between a leading edge of the cutoff and a plurality of various sized impellers in the blower housing, and wherein the adjustable cutoff is positioned radially between an axis of rotation of the blower assembly and the second mounting hole when the adjustable cutoff is secured in the second position, and the adjustable cutoff is positioned radially between the first mounting hole and the second mounting hole when the adjustable cutoff is secured in the first position;

wherein the fastener is selectively positionable within the first mounting hole to secure the adjustable cutoff in the first position and within the second mounting hole to secure the adjustable cutoff in the second position, and wherein tension in the adjustable cutoff biases the adjustable cutoff radially outwards against the fastener when the adjustable cutoff is secured in the first position and the fastener is positioned in the first mounting hole.

10. The HVAC system of claim 9, wherein the second position of the cutoff is radially inward from the first position of the cutoff with respect to an axis of rotation of a first impeller and a second impeller.

11. The HVAC system of claim 9, wherein the adjustable cutoff is selectively adjustable between the first position to accommodate a first impeller and the second position to accommodate a second impeller comprising a smaller diameter than the first impeller.

12. The HVAC system of claim 9, wherein the adjustable cutoff is selectively adjustable to maintain the clearance that comprises between 5% and 10% of the diameter of one of the plurality of various sized impellers.

13. The HVAC system of claim 9, wherein the component is an air handling unit.

14. The HVAC system of claim 9, wherein the component is a furnace.

15. The blower assembly of claim 1, wherein:

the adjustable cutoff comprises a pivot point and a curved outer surface extending from the pivot point;

the curved outer surface of the adjustable cutoff is positioned radially between the axis of rotation of the blower assembly and the second mounting hole when the adjustable cutoff is secured in the second position; and the curved outer surface of the adjustable cutoff is positioned radially between the first mounting hole and the second mounting hole when the adjustable cutoff is secured in the first position.

16. The blower assembly of claim 15, wherein the curved outer surface of the adjustable cutoff comprises the leading edge configured to separate a discharge airflow from an incoming airflow collected in the blower housing.

17. The HVAC system of claim 9, wherein:

the adjustable cutoff comprises a pivot point and a curved outer surface extending from the pivot point;

the curved outer surface of the adjustable cutoff is positioned radially between the axis of rotation of the blower assembly and the second mounting hole when the adjustable cutoff is secured in the second position; and the curved outer surface of the adjustable cutoff is positioned radially between the first mounting hole and the second mounting hole when the adjustable cutoff is secured in the first position.

18. The HVAC system of claim 17, wherein the curved outer surface of the adjustable cutoff comprises the leading edge configured to separate a discharge airflow from an incoming airflow collected in the blower housing.

* * * * *